US010645521B2

(12) United States Patent
Mihelich et al.

(10) Patent No.: US 10,645,521 B2
(45) **Date of Patent: *May 5, 2020**

(54) STEREO AND FILTER CONTROL FOR MULTI-SPEAKER DEVICE

(71) Applicant: Apple Inc., Cupertino, CA (US)

(72) Inventors: Ryan J. Mihelich, Morgan Hill, CA (US); Tomlinson Holman, Cupertino, CA (US); Alexander P. Niemeyer, Sunnyvale, CA (US); Timothy E. Sandrik, Ben Lomond, CA (US)

(73) Assignee: Apple Inc., Cupertino, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/942,287

(22) Filed: Mar. 30, 2018

(65) Prior Publication Data

US 2018/0249278 A1 Aug. 30, 2018

Related U.S. Application Data

(63) Continuation of application No. 15/256,384, filed on Sep. 2, 2016, now Pat. No. 9,949,057.

(Continued)

(51) Int. Cl.

| | |
|---|---|
| ***H04R 5/02*** | (2006.01) |
| ***H04S 7/00*** | (2006.01) |
| ***H04R 3/12*** | (2006.01) |

(52) U.S. Cl.

CPC ..... *H04S 7/307* (2013.01); *H04R 3/12* (2013.01); *H04R 5/02* (2013.01); *H04S 7/302* (2013.01);

(Continued)

(58) Field of Classification Search

CPC ..... H04S 7/307; H04S 7/302; H04R 3/12; H04R 5/02; H04R 2460/07; H04R 2499/11; H04R 2499/15

(Continued)

(56) References Cited

U.S. PATENT DOCUMENTS

| | | | | |
|---|---|---|---|---|
| 8,600,084 | B1 | 12/2013 | Garrett | H04R 5/04 381/123 |
| 9,241,217 | B2 * | 1/2016 | Rodgers | H04R 5/02 |
| 9,621,124 | B2 | 4/2017 | Lu | H03G 5/005 |

(Continued)

FOREIGN PATENT DOCUMENTS

| | | |
|---|---|---|
| CN | 1875656 | 12/2006 |
| CN | 101742378 | 6/2010 |

(Continued)

OTHER PUBLICATIONS

Chinese Office Action with English Translation, dated Nov. 23, 2017, Chinese Application No. 201610996847.9.

*Primary Examiner* — Disler Paul

(74) *Attorney, Agent, or Firm* — Womble Bond Dickinson (US) LLP

(57) ABSTRACT

A portable electronic device includes several speakers spaced apart from one another on opposite sides of the device. An audio processor attenuates high frequency portions of a first audio signal and a second audio signal to provide a processed first audio signal and a processed second audio signal. An audio router directs the first audio signal to only a first speaker on a first side of the device, and directs the second audio signal to only a second speaker on a second side of the device. The audio signals may be directed according to an orientation of the device.

22 Claims, 8 Drawing Sheets

Related U.S. Application Data

(60) Provisional application No. 62/215,288, filed on Sep. 8, 2015.

(52) U.S. Cl.
CPC ..... *H04R 2460/07* (2013.01); *H04R 2499/11* (2013.01); *H04R 2499/15* (2013.01)

(58) Field of Classification Search
USPC ..... 381/300, 303–304
See application file for complete search history.

(56) References Cited

U.S. PATENT DOCUMENTS

| | | | | |
|---|---|---|---|---|
| 2007/0098191 | A1* | 5/2007 | Wan | H04S 7/302 381/306 |
| 2008/0130905 | A1 | 6/2008 | Fincham | H04S 1/002 381/18 |
| 2011/0002487 | A1* | 1/2011 | Panther | H04R 5/04 381/300 |
| 2011/0194712 | A1 | 8/2011 | Potard | H04S 1/002 381/300 |
| 2012/0051567 | A1* | 3/2012 | Castor-Perry | H04R 29/002 381/304 |
| 2013/0163794 | A1* | 6/2013 | Groves | H04R 3/12 381/303 |
| 2014/0219482 | A1* | 8/2014 | Jia | H04R 5/02 381/300 |
| 2014/0233771 | A1 | 8/2014 | Giustina | H04R 5/04 381/304 |
| 2014/0233772 | A1* | 8/2014 | Giustina | H04R 5/04 381/306 |
| 2015/0023533 | A1 | 1/2015 | Johnson | H04R 3/12 381/306 |
| 2015/0078555 | A1* | 3/2015 | Zhang | H04M 1/035 381/26 |
| 2015/0181337 | A1* | 6/2015 | Rodgers | H04R 5/02 381/304 |
| 2015/0189438 | A1 | 7/2015 | Hampiholi | G06F 3/165 381/80 |
| 2016/0381487 | A1* | 12/2016 | Harvey | H04R 5/04 381/303 |

FOREIGN PATENT DOCUMENTS

| | | |
|---|---|---|
| CN | 101946526 | 1/2011 |
| CN | 103491482 | 1/2014 |
| CN | 203734829 | 7/2014 |
| CN | 103581791 | 9/2014 |

* cited by examiner

STEREO AND FILTER CONTROL FOR MULTI-SPEAKER DEVICE

This is a continuation of co-pending U.S. application Ser. No. 15/256,384 filed Sep. 2, 2016, which claims the benefit of U.S. Provisional Application No. 62/215,288 filed Sep. 8, 2015.

FIELD

Embodiments of the invention relate to the field of wired one-way processing systems for audio signals where there are two or more independent audio signals which are to be separately reproduced so as to create a sense of depth; and more specifically, to audio processing systems that create two or more processed audio signals from each of the independent audio signals by a spectral adjustment to at least one of the processed audio signals.

BACKGROUND

A portable electronic device, such as a tablet computer, may include multiple speakers to provide a stereo audio presentation to a user of the device. In a stereo audio presentation, the audio signal that represents the left channel will be directed to speakers on the left side of the device as oriented with respect to the user. Likewise, the right channel signal will be directed to speakers on the right side of the device. The device may include four or more speakers symmetrically arranged on the device with respect to both the vertical and horizontal centerlines of a display surface to be viewed by the user. This will provide a generally similar stereo audio presentation to the listener in any of the four orientations of a rectangular device, if the sound is routed appropriately for the orientation.

It is desirable to route the audio signal that represents the left channel to all the speakers on the left side of the device to increase the maximum loudness and dynamic range, and to better center the apparent center of the sound field along the vertical axis of the device with respect to the listener. However, when the same audio signal is sent to two speakers, there will be a destructive interference of the resulting sound waves from the two speakers at certain places within the sound field produced. The locations of these areas of destructive interference are dependent on the frequency of the sound wave and the distance between the speakers.

It would be desirable to provide a way to minimize the destructive interference in the sound field of a portable electronic device in which the audio signal for each channel is routed to more than one speaker.

BRIEF DESCRIPTION OF THE DRAWINGS

The invention may be understood by referring to the following description and accompanying drawings that are used as examples to illustrate embodiments of the invention. The invention is not limited to the examples of the description and drawings. In the drawings, in which like reference numerals indicate similar elements.

DETAILED DESCRIPTION

Figure 1:
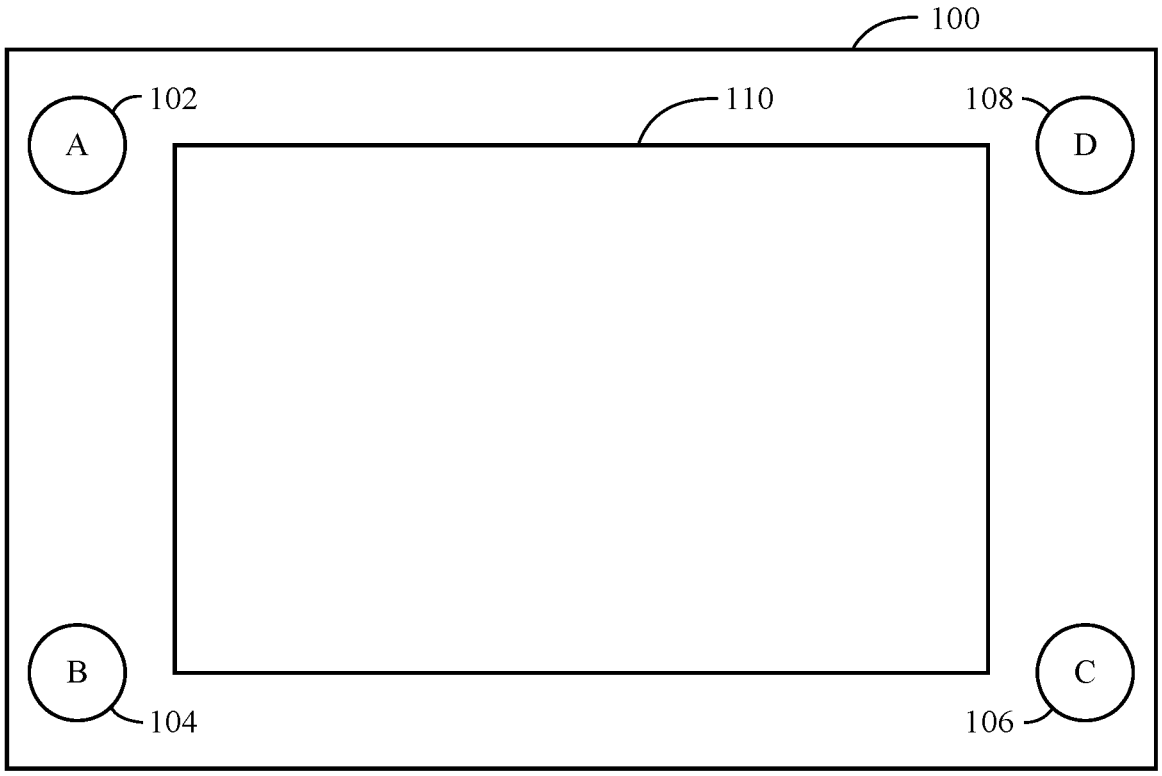
FIG. 1 is a view of an illustrative portable electronic device having four speakers located generally at the four corners of the device.

In the following description, numerous specific details are set forth. However, it is understood that embodiments of the invention may be practiced without these specific details. In other instances, well-known circuits, structures and techniques have not been shown in detail in order not to obscure the understanding of this description.

In the following description, reference is made to the accompanying drawings, which illustrate several embodiments of the present invention. It is understood that other embodiments may be utilized, and mechanical compositional, structural, electrical, and operational changes may be made without departing from the spirit and scope of the present disclosure. The following detailed description is not to be taken in a limiting sense, and the scope of the embodiments of the present invention is defined only by the claims of the issued patent.

The terminology used herein is for the purpose of describing particular embodiments only and is not intended to be limiting of the invention. Spatially relative terms, such as "up", "down", "left", "right", "beneath", "below", "lower", "above", "upper", and the like may be used herein for ease of description to describe one element's or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (e.g., rotated 90 degrees or at other orientations) and the spatially relative descriptors used herein interpreted accordingly.

As used herein, the singular forms "a", "an", and "the" are intended to include the plural forms as well, unless the context indicates otherwise. It will be further understood that the terms "comprises", "comprising", "includes", and "including" specify the presence of stated features, steps, operations, elements, components, items, species, and/or groups but do not preclude the presence, existence, or addition of one or more other features, steps, operations, elements, components, items, species, and/or groups thereof.

The terms "or" and "and/or" as used herein are to be interpreted as inclusive or meaning any one or any combination. Therefore, "A, B or C" or "A, B and/or C" mean "any of the following: A; B; C; A and B; A and C; B and C; A, B and C." An exception to this definition will occur only when a combination of elements, functions, steps or acts are in some way inherently mutually exclusive.

For the purposes of this application "audio signal" will be used to describe an electrical representation of a sound. "Sound" will be used to describe a sound pressure wave in air that is emitted by a speaker to produce an audible sound for a listener. An audio signal may be sent to a speaker to produce a sound. The terms speaker and speaker are used interchangeably to describe an electrical transducer that converts an electrical input into an audible sound pressure wave that travels through the air to a listener. A speaker does not, for the purposes of this application, include an earphone where the transducer is acoustically closely coupled to the ear of the listener such that the sound pressure wave is at least somewhat confined to the ear of the listener.

FIG. 1 is a view of an illustrative portable electronic device 100 having four speakers 102, 104, 106, 108 (e.g., loudspeakers) located generally at the four corners of the device. The device includes a display screen 110 that faces in the same direction as the speakers to deliver audio-visual content to a user of the device. In one embodiment, all of the speakers are integrated within the same housing of the portable electronic device 100, and are arranged outward of the display screen while being acoustically open through the same face of the housing in which the display screen, e.g., a touchscreen within the housing of a tablet computer, is to be viewed.

More generally, a portable electronic device that embodies the invention will have four or more speaker components (or speakers), each having similar sound reproduction capabilities, spaced apart from each other but arranged symmetrically on the device such that a similar array of speakers faces the user in all four orientations of the device in which there are two vertical sides and two horizontal sides. In any given orientation the two vertical sides can be considered as a left side and a right side. There will be at least two speakers on the left side and at least two speakers on the right side. To present a stereophonic audio program the audio signals representing the left side of the program will be sent to speakers on the left side of the device based on the device orientation. Audio signals representing the right side of the program will be sent to speakers on the right side of the device based on the device orientation.

Figure 2:
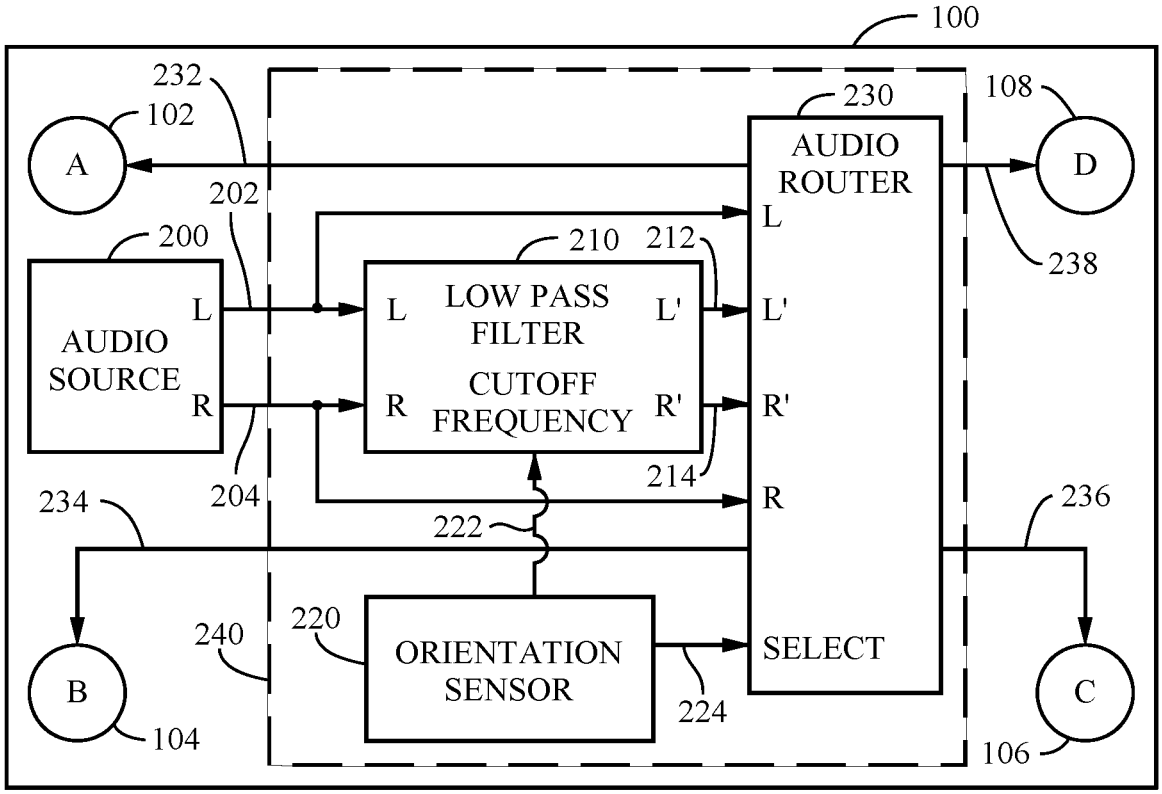
FIG. 2 is a block diagram of the illustrative portable electronic device showing the audio processing components for processing and routing the audio signals according to the device orientation.

FIG. 2 is a block diagram of the illustrative portable electronic device 100 showing an audio management system 240 for processing and routing the audio signals. An audio source 200 provides a left audio signal 202 and a right audio signal 204. The left and right audio signals may be provided to an audio router 230 of the audio management system 240 that directs the left audio signal 202 to speakers on the left side of the device and the right audio signal 204 to speakers on the right side of the device. The audio management system 240 may include an orientation sensor 220 that may provide an orientation signal 224 to a select input of the audio router 230 to control to which speaker or speakers each of the audio signals is routed.

Figure 3:
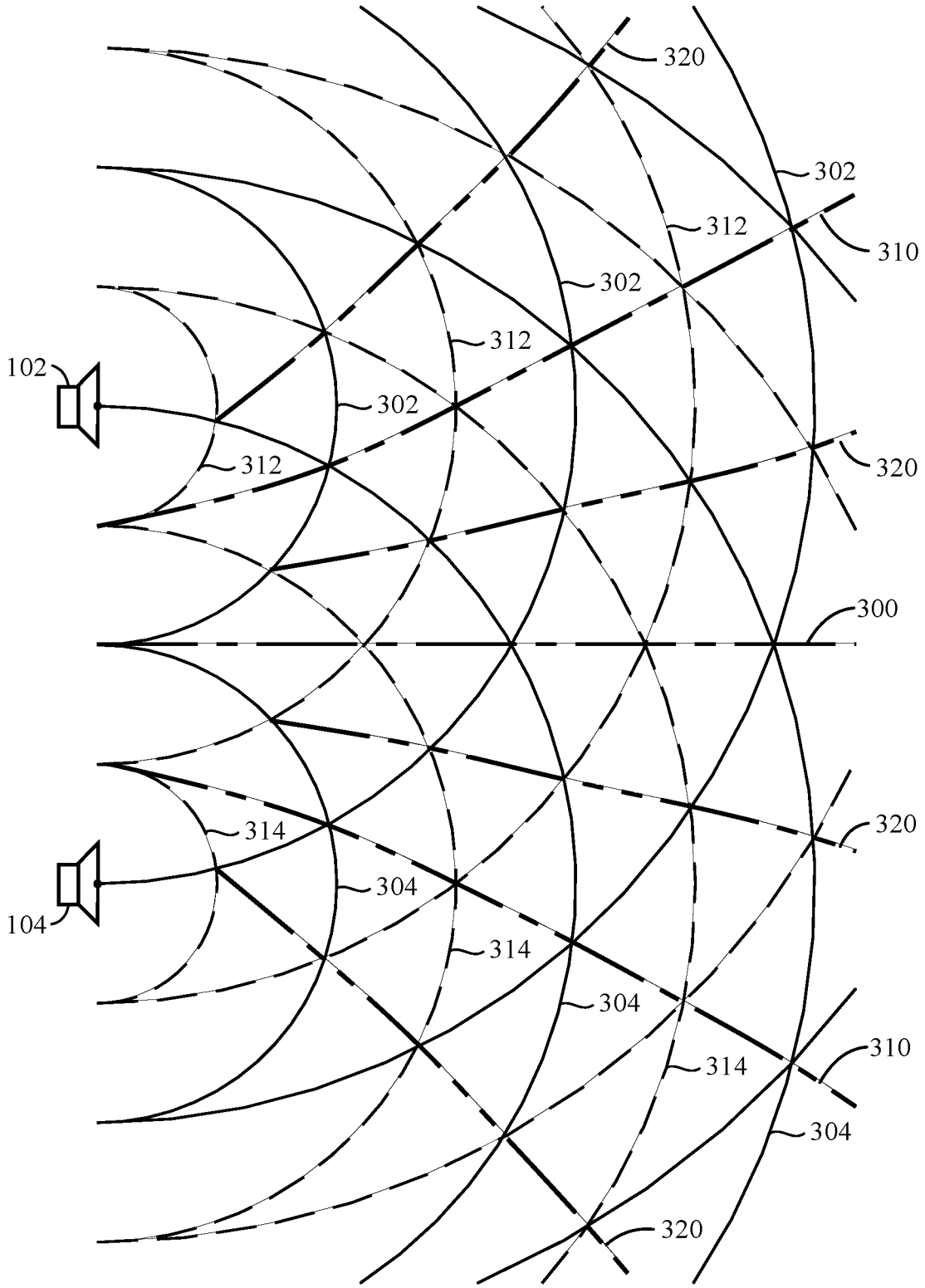
FIG. 3 is a side view of two speakers suggesting a sound having a wavelength that is one-half the distance between the speakers.

FIG. 3 is a side view of two speakers 102, 104 that are receiving the same audio signal. The figure suggests a sound that is a pure sine wave having a wavelength that is one-half the distance between the speakers 102, 104. Solid semicircular lines 302, 304 suggest locations or positions in space that are in front of the speakers 102, 104 where there is a maximum sound pressure from each of the speakers 102, 104. Dashed semicircular lines 312, 314 suggest locations or positions where there is a minimum sound pressure from each of the speakers 102, 104. If the distance between the speakers 102, 104 is 20 cm., the sound would have a wavelength of 10 cm. and a frequency of about 3,400 Hz.

When the distance to each of the two speakers 102, 104 is equal or differs by an integer number of wavelengths, the sound pressures from each of the speakers 102, 104 will reinforce one another to produce a maximum sound pressure level. The distance to each of the two speakers 102, 104 is equal along the perpendicular bisecting plane 300 of a line between the two speakers. Being on the bisecting plane 300 may be described as being on-axis. There may be additional surfaces 310 where the distance to each of the two speakers 102, 104 differs by an integer number of wavelengths and the speakers produce a maximum sound pressure level. The location or position of these additional surfaces 310 depends on the wavelength of the sound with respect to the distance between the two speakers. The sound waves from the two speakers can be described as being in-phase for a particular frequency when the maximum sound pressure from each of the speakers coincides to produce a maximum sound pressure level.

When the distance to each of the two speakers 102, 104 differs by an integer number of wavelengths plus one-half wavelength, the sound pressures from each of the speakers 102, 104 will destructively interfere with one another to produce a minimum sound pressure level. The surfaces 320 where the maximum sound pressure 302 from one of the two speakers 102 coincides with the minimum sound pressure 314 from the other of the speakers 104 are suggested by lines with a long dash separated by two short dashes. This destructive interference 320 of the sound waves 302, 312, 304, 314 from the two speakers 102, 104 produces an undesirable effect known as "lobing" where changing frequencies in the audio signal are attenuated as the listener moves to different positions away from the ideal on-axis position, which may be described as moving off-axis. The listener may experience undesirable psychoacoustic effects because of the notches in the frequency spectrum that lobing causes.

Figure 4:
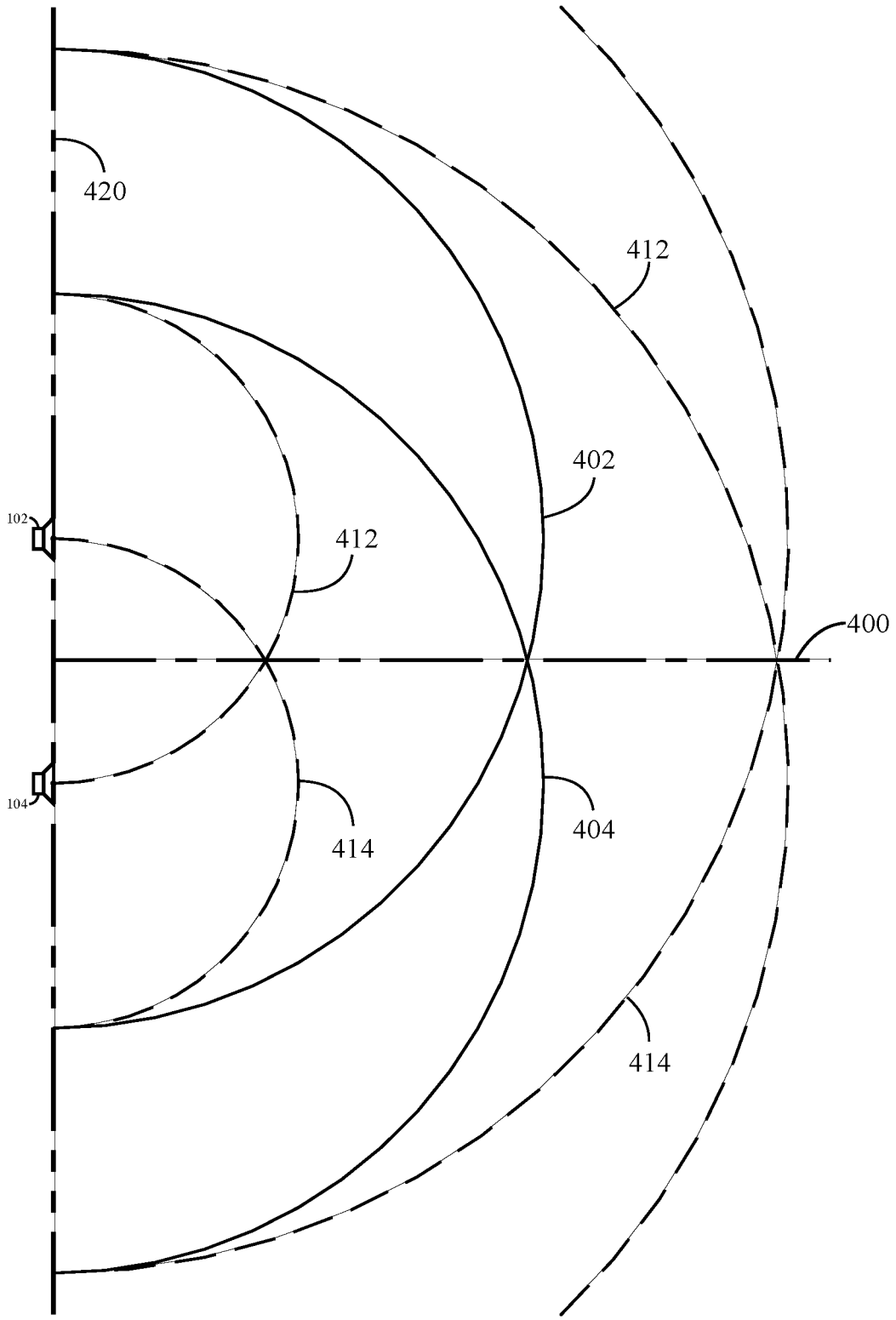
FIG. 4 is another side view of the two speakers suggesting a second sound having a wavelength that is twice the distance between the speakers.

FIG. 4 is another side view of the two speakers 102, 104 suggesting a second sound that is a pure sine wave having a wavelength that is twice the distance between the speakers 102, 104. This second sound has a frequency that is one-fourth that of the sound shown in FIG. 3. Solid semicircular lines 402, 404 suggest a maximum sound pressure from each of the speakers 102, 104. Dashed semicircular lines 412, 414 suggest a minimum sound pressure from each of the speakers 102, 104. If the distance between the speakers 102, 104 is 20 cm., the sound would have a wavelength of 40 cm. and a frequency of about 860 Hz.

As in FIG. 3, the distance to each of the two speakers 102, 104 is equal along the perpendicular bisecting plane 400 of a line between the two speakers and the speakers produce a maximum sound pressure level at this plane. The distance to each of the two speakers 102, 104 differs by one-half wavelength along the line 420 that passes through the two speakers and the sound pressures from each of the speakers 102, 104 will destructively interfere with one another to produce a minimum sound pressure level along this line. At all other places within the sound field the sound pressure level will be greater than the minimum level. While the sound pressure level for this frequency is reduced as the listener moves off-axis, the reduction is gradual and the listener does not experience multiple peaks and valleys in level as they do with higher frequencies, such as at the frequency illustrated in FIG. 3.

As the wavelength of the sound is increased to more than twice the distance between the speakers 102, 104, which is equivalent to lowering the frequency, there will be no place in the sound field where there is completely destructive interference. The reductions in sound pressure level as the listener moves off-axis will become more gradual as the wavelength of the sound is further increased and the frequency becomes lower. It is generally considered that the effects of lobing become negligible for frequencies having a wavelength of four times the distance between the speakers or greater.

It is desirable to use more than one speaker on one side of a stereo field to increase the maximum sound pressure levels available and hence the dynamic range of the audio system. It is also desirable to use more than one speaker on one side of a stereo field to better center the apparent origin of the audio signal between the speakers so that the audio presentation appears to originate more toward the center of the display screen 110 on the device 100. However, as described above, providing the same audio signal to two speakers gives rise to undesirable lobing because of destructive interference between the sound waves produced by the speakers.

Referring again to FIG. 2, the audio source 200 provides the left and right audio signals 202, 204 to the audio management system 240. The audio management system 240 includes an audio processor 210, such as a low-pass filter, that receives the audio signals 202, 204 from the audio source 200. The audio processor 210 attenuates a high frequency portion of the left and right audio signals 202, 204 to produce processed left and right audio signals 212, 214. The processed left and right audio signals are provided to the audio router 230 of the audio management system 240. The audio router 230 directs the processed left audio signal 212 to all but one of the speakers on the left side of the device and the processed right audio signal 214 to all but one of the speakers on the right side of the device.

The audio router 230 directs the left audio signal 202 with the high frequency portion of the left audio signal to only one speaker on the left side of the device 100. Likewise, the audio router 230 directs the right audio signal 204 with the high frequency portion of the right audio signal to only one speaker on the right side of the device 100. In this way, the high frequency portion of the audio program is limited to a single speaker on each side of the device to minimize the undesirable lobing effect. The low frequency portion of the audio program, which has a lesser contribution to lobing, is delivered to all speakers to maximize the sound pressure levels of the delivered audio program.

The cutoff frequency and roll-off rate of the low-pass filter for attenuating a portion of the audio signal may be "tuned" experimentally to produce the desired psychoacoustic effect for an audio presentation on the device. In some embodiments, a second order low-pass filter may be used to eliminate the high frequency portion of the audio signal. In other embodiments, a shelf filter may be used to attenuate the high frequency portion of the audio signal without entirely eliminating the high frequency portion.

It will be appreciated that the distance between the speakers on the left and right sides of the device 100 may change based on the orientation of the device. For example, as shown in FIG. 1, speakers A 102 and B 104 are on the left side of the device 100 and speaker C 106 and D 108 are on the right side. Each of these speaker pairs are a first distance apart. When the device is rotated ninety degrees clockwise, speakers B 104 and C 106 are on the left side of the device 100 and speaker D 108 and A 102 are on the right side. These speaker pairs are a second distance apart that is greater than the first distance. It may be desirable to provide a different cutoff frequency and/or other processing parameters for producing the processed left and right audio signals 212, 214 responsive to the orientation of the device. The audio management system's orientation sensor 220 may provide an orientation signal 222 to the low-pass filter to control how the audio signals 202, 204 are processed.

Figure 5A:
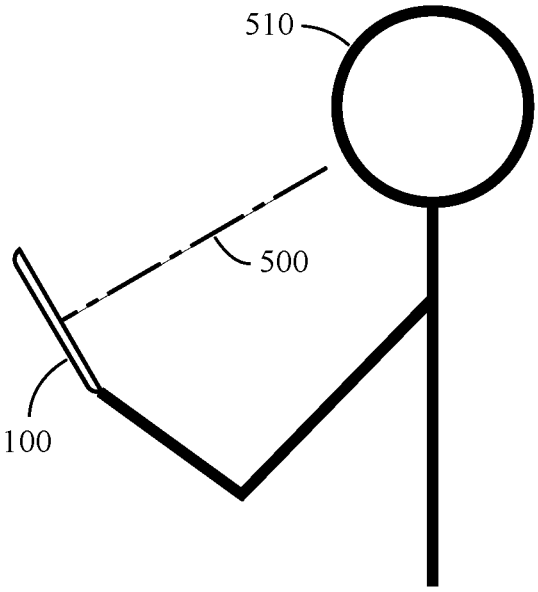
FIG. 5A shows a user holding the portable electronic device in the on-axis position.

FIG. 5A shows a user 510 holding the portable electronic device 100 in the on-axis 500 position. In this position the user 510 is in the area within the sound field where the distance to each of the speakers is approximately equal. The sound pressures from each of the speakers will reinforce one another to produce a maximum sound pressure level at the user's listening position.

Figure 5B:
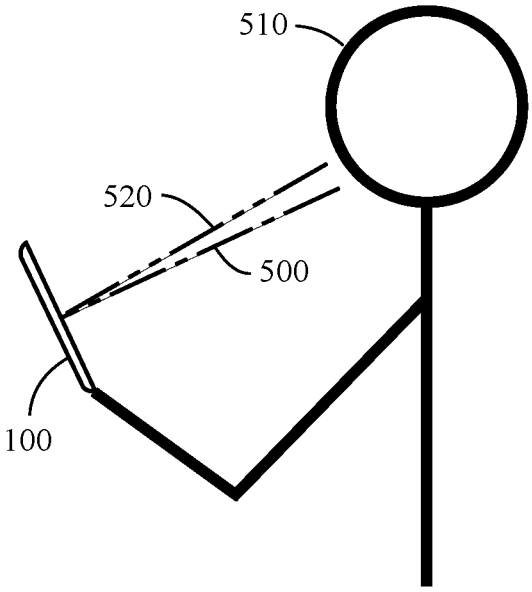
FIG. 5B shows the user holding the portable electronic device in an off-axis position.

FIG. 5B shows the user 510 holding the portable electronic device 100 in an off-axis 520 position with the top edge of the device angled toward the user. The device is tilted by rotation of the device around a horizontal axis extending between the left and right sides of the device. In some embodiments, the orientation sensor 220 may sense such tilting of the device 100 to estimate the position of the user 510 with respect to the on-axis position. The device tilt may be used to further adjust the operation of the low-pass filter. In one embodiment, the device tilt may be used to controllably delay the audio signals being directed to speakers that are a horizontal edge that is closer to the user 510 because of tilting of the device to redirect the on-axis 500 position toward the user. The audio signals may be delayed at the rate of about 74 microseconds per inch of speaker movement toward the user due to tilting.

In one embodiment, the orientation sensor 220 may sense tilting of the device 100 to an approximately horizontal position, such as when the device is laying on a table, and the low-pass filter may be adjusted such that a sound field suitable for listening over a wide area is presented.

Figure 7:
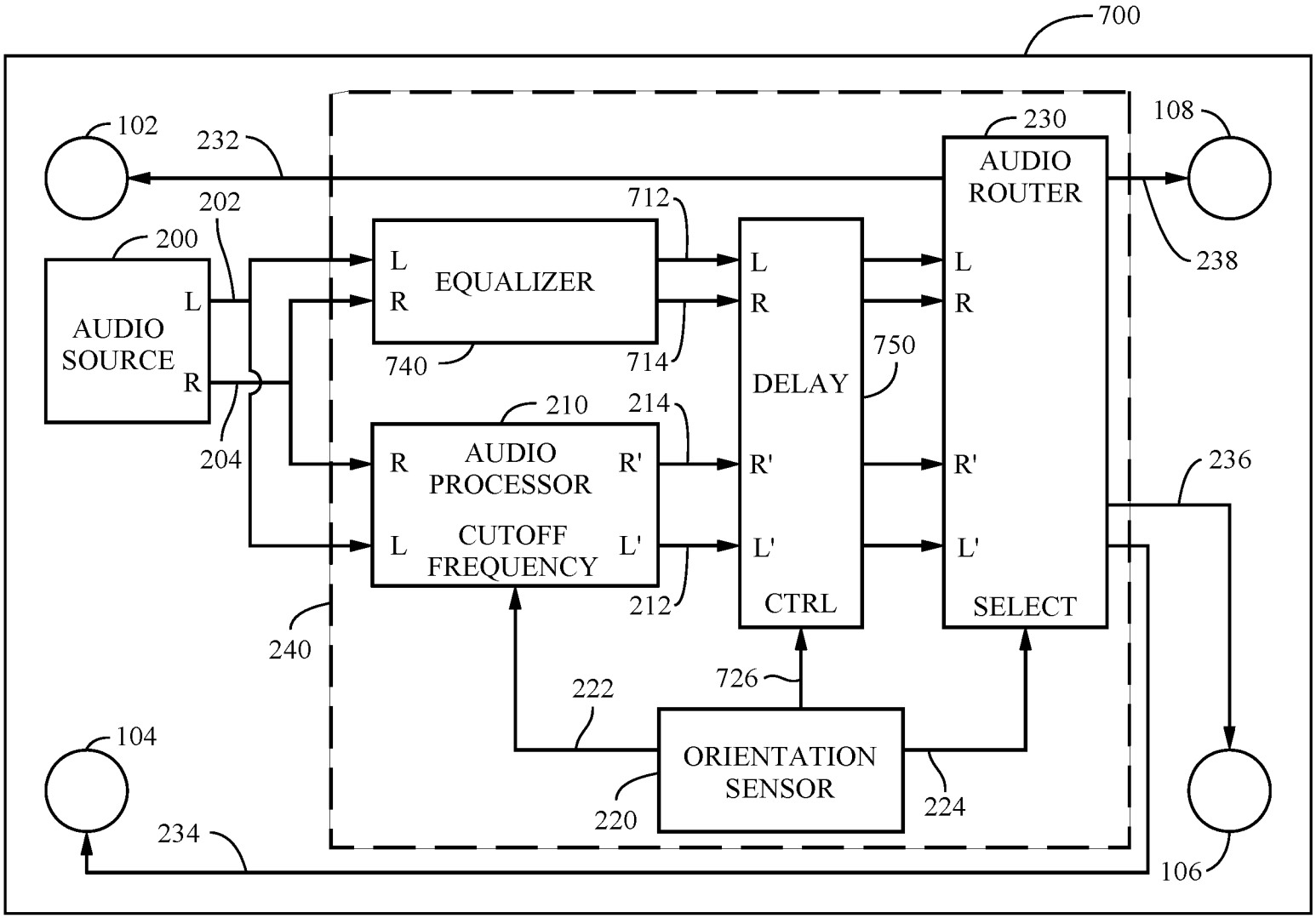
FIG. 7 is a block diagram of another embodiment of the audio processing components for processing and routing the audio signals according to the device orientation.

FIG. 7 is a block diagram of another embodiment of the audio management system 240 for processing and routing the audio signals to the speakers 102, 104, 106, 108 of a device 700. The device 700 may include an orientation sensor 220 as part of the audio management system 240 to provide orientation signals 222, 224, 726 to control various aspects of the processing and routing of the audio signals.

An audio source 200 provides a left audio signal 202 and a right audio signal 204. The left and right audio signals 202, 204 are coupled to an audio processor 210 that attenuates a high frequency portion of the left and right audio signals 202, 204 to produce processed left and right audio signals 212, 214. The cut-off frequency for the high frequency portion of the audio signals may be adjusted responsive to the device orientation. The cut-off frequency for the high frequency portion of the audio signals may be further adjusted by a spectrum analyzer portion (not shown) of the audio processor 210, responsive to the frequency spectrum of the content represented by the audio signals 202, 204. The left and right audio signals 202, 204 may also be coupled to an equalizer 740 that boosts or emphasizes the high frequency portion of the left and right audio signals 202, 204 to produce enhanced left and right audio signals 712, 714.

The processed left and right audio signals 212, 214 and the enhanced left and right audio signals 712, 714 are coupled to a delay processor that may time delay the audio signals that will be routed to speakers that are closer to the listener due to device tilting. The audio signals are provided to the audio router 230. The audio router directs the enhanced left audio signal 712 to only one speaker that is on the left side of the device in its current orientation. The audio router directs the enhanced right audio signal 714 to only one speaker that is on the right side of the device in its current orientation. The processed left and right audio signals 212, 214 are directed to one or more of the remaining speakers on the appropriate side of the device 700.

Figure 6:
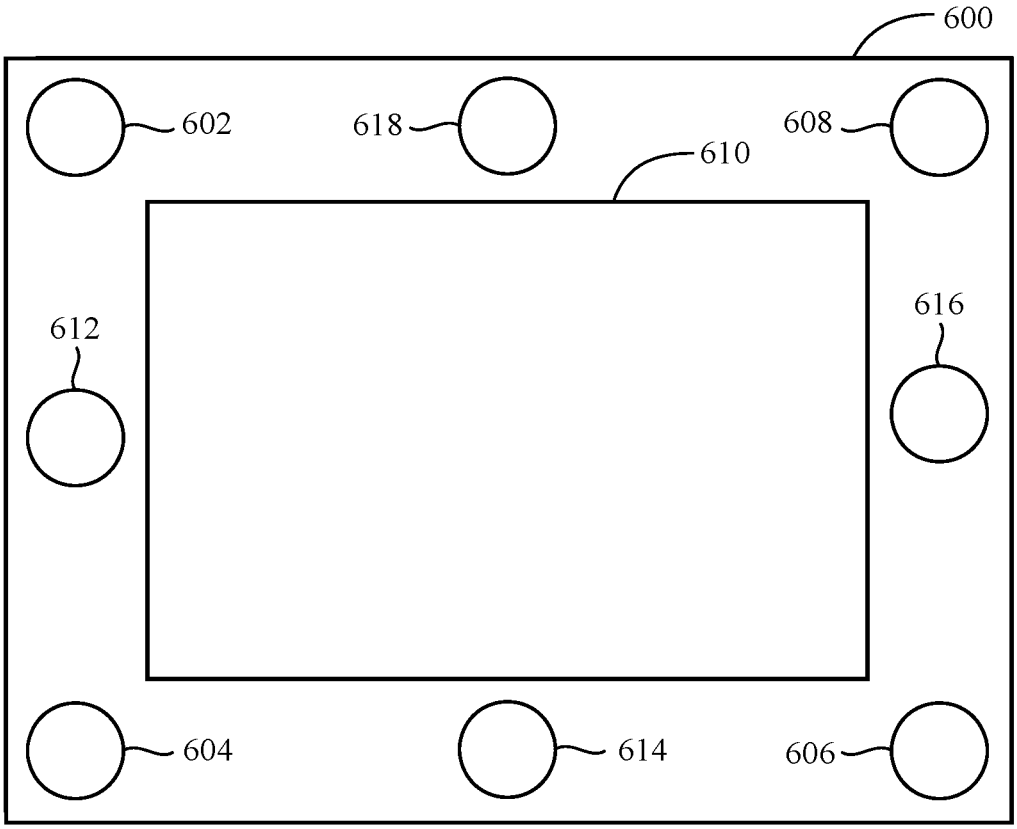
FIG. 6 shows a portable electronic device having eight speakers arranged around a display screen.

FIG. 6 shows a portable electronic device 600 having eight speakers 602, 604, 606, 608, 612, 614, 616, 618 arranged around a display 610. In this embodiment, the left and right audio signals may each be directed to one of the four "centered" speakers 612, 614, 616, 618 according to which two of the four "centered" speakers are on the left and right sides of the device 600. The processed left and right audio signals in which the high frequencies are attenuated are directed to the four "corner" speakers 602, 604, 606, 608 with appropriate selections of the left and right signals. The other two of the four "centered" speakers that are on the top and bottom sides of the device 600 may be unused or one or both may receive of mix of the processed left and right audio signals. It will be noted that regardless of the number of speakers, the left and right audio signals with unattenuated high frequencies are each directed to only a single speaker.

Figure 8:
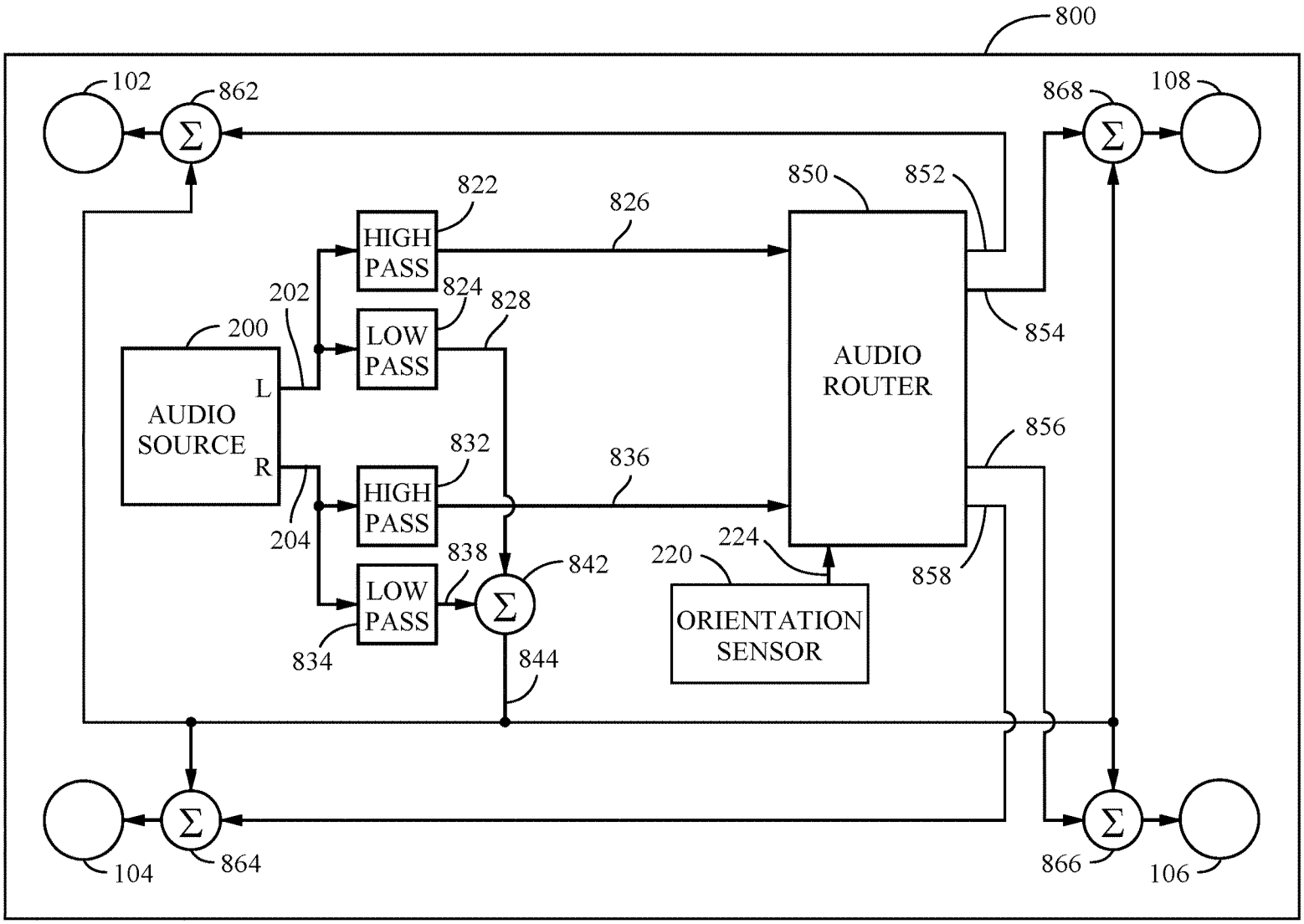
FIG. 8 is a block diagram of another embodiment of the audio management for processing and routing the audio signals to the speakers

FIG. 8 is a block diagram of another embodiment of the audio management for processing and routing the audio signals to the speakers 102, 104, 106, 108 of a device 800. The device 800 may include an orientation sensor 220 to provide an orientation signal 224 to control routing of the audio signals.

An audio source 200 provides a left audio signal 202 and a right audio signal 204. The left and right audio signals 202, 204 are each coupled to a high-pass filter 822, 832 and a low-pass filter 824, 834 to separate the audio signals into high frequency and low frequency portions. The high and low-pass filters may be matched such that the high and low frequency portions can be recombined to provide a signal that is substantially the same as the audio signal provided to the high and low-pass filters. In some embodiments (not shown) a signal from the orientation sensor 220 may be used to adjust the high and low-pass filters responsive to the device orientation similarly to the embodiment shown in FIG. 7.

The left high frequency portion 826 of the left audio signal 202 and the right high frequency portion 836 of the right audio signal 204 are provided to the audio router 850. The audio router directs the left high frequency portion 826 to only one speaker that is on the left side of the device in its current orientation. The audio router directs the right high frequency portion 836 to only one speaker that is on the right side of the device in its current orientation. This may reduce the undesirable lobing effects as described above.

The speakers 102, 104, 106, 108 may all have similar sound reproduction capabilities. Each speaker may be relatively small and lack the capacity to move a large volume of air as needed to reproduce lower frequencies effectively. In this embodiment, the left low frequency portion 828 of the left audio signal 202 and the right low frequency portion 838 of the right audio signal 204 are combined by a bass mixer 842 to provide a single bass signal 844 that includes the left and right low frequency portions 828, 838 of the left and right audio signals 202, 204. The single bass signal 844 is routed to all speakers 102, 104, 106, 108 of the device 800.

Speaker mixers 862, 864, 866, 868 each receive the single bass signal 844 and may receive one of the high frequency portions 826, 836 as determined by the device 800 orientation. Each speaker mixer 862, 864, 866, 868 is coupled to one of the speakers 102, 104, 106, 108 to provide a combined audio signal that drives the speaker. By providing the same bass signal 844 to all of the speakers, a larger volume of air can be moved by the cooperative action of all the speakers to reproduce lower frequencies more effectively. As discussed above, lower frequencies do not produce a lobing effect even though all the speakers of the device are reproducing the same low frequency content.

Figure 9:
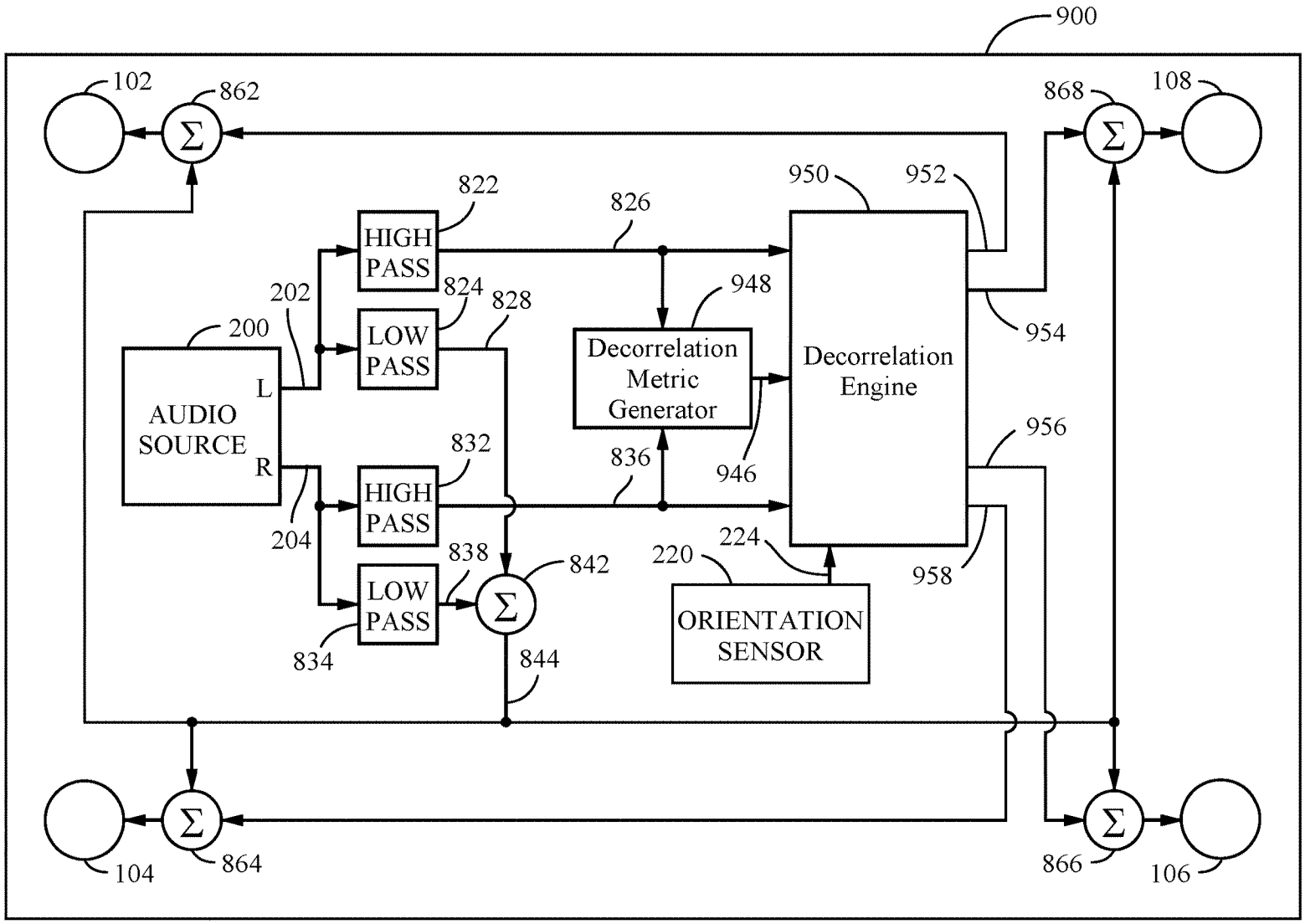
FIG. 9 is a block diagram of another embodiment of the audio management for processing and routing the audio signals to the speakers

FIG. 9 is a block diagram of another embodiment of the audio management for processing and routing the audio signals to the speakers 102, 104, 106, 108 of a device 900. The audio source 200 provides left and right audio signals 202, 204 that are each coupled to high and low-pass filters 822, 832, 824, 834 to separate the audio signals into high frequency and low frequency portions as described above. A configuration with four speakers and two audio channels (or also referred to as audio channel signals) is presented as an exemplary configuration of an audio device. The invention may be applied to devices with a different number of speakers and/or presenting a different number of channels (or channel signals).

The left high frequency portion 826 of the left audio signal 202 and the right high frequency portion 836 of the right audio signal 204 are provided to a decorrelation engine 950. The decorrelation engine shifts the phases of the components of the audio signals it receives. The decorrelation engine produces a decorrelated version 958 of the left high frequency portion 826 of the left audio signal 202 and a decorrelated version 956 of the right high frequency portion 836 of the right audio signal 204. The decorrelated version of the high frequency portion of the audio signal produces a sound that is aurally similar to a sound produced by the high frequency portion of the audio signal when the signals are reproduced by a speaker. However, because of the phase shifts in the decorrelated version, the decorrelated version may be played in a speaker adjacent to a speaker playing the high frequency portion with less of an undesirable lobing effect.

The decorrelation engine 950 may include an audio router to direct the left high frequency portion 952 and the decorrelated version 958 of the left high frequency portion 826 to speakers that are on the left side of the device in its current orientation as indicated by an orientation signal 224 from an orientation sensor. The audio router may direct the right high frequency portion 954 and the decorrelated version 956 of the right high frequency portion 826 to speakers that are on the right side of the device in its current orientation. If the device orientation is fixed, the decorrelation engine may direct the audio signals as necessary without using an orientation sensor. It will be appreciated that the decorrelation engine may provide additional decorrelated versions of the high frequency portion of an audio channel to allow more than two speakers to reproduce the sound for that audio channel.

It will be appreciated that the left high frequency portion 826 of the left audio signal 202 and the right high frequency portion 836 of the right audio signal 204 may be correlated to a greater or lesser degree according to the source material of the audio source 200. At one extreme the left and right channels may be of entirely different audio material with no correlation between the two channels. At the other extreme, monophonic material may be encoded so that the left and right channels are identical and completely correlated. Between these extremes the left and right channels may include some material, such as a vocal track, that is identical in both channels while other material, such as an instrumental accompaniment, differs between the channels to a greater or lesser degree. Thus the correlation between the high frequency portion of the channels can vary based on the audio source material that can, in turn, vary over time.

To reduce undesirable lobing effects from correlation between the channels, the device may include a decorrelation metric generator 948 that determines the correlation between the high frequency portions 822, 832 of the audio source channels 202, 204 and provides a channel decorrelation metric 946 to the decorrelation engine 950 responsive to the amount of decorrelation needed. This may also be viewed as a comparison or compare of the high pass filtered versions of the audio source channels 202, 204. The decorrelation engine shifts the phases of the channel signals it receives to produce intermediate channel signals responsive to the channel decorrelation metric 946. It will be appreciated that the decorrelation engine may modify one or both channels to decorrelate the signals and produce the intermediate channel signals. The decorrelation engine may then further produce a decorrelated version 958 of the left intermediate high frequency portion 826 of the left audio signal 202 and a decorrelated version 956 of the right intermediate high frequency portion 836 of the right audio signal 204. This may reduce undesirable lobing effects between the channels in addition to reduce undesirable lobing effects between multiple speakers that produce sound for the same channel. While decorrelation has been described for two channels and two speakers per channel, it will be understood that the invention may be applied to devices with differing numbers of channels and differing numbers of speakers per channel.

Speaker mixers 862, 864, 866, 868 each receive the single bass signal 844 and one of the decorrelated high frequency portions 952, 954, 956, 958. Each speaker mixer 862, 864, 866, 868 is coupled to one of the speakers 102, 104, 106, 108 to provide a combined audio signal that drives the speaker. By providing the same bass signal 844 to all of the speakers, a larger volume of air can be moved by the cooperative action of all the speakers to reproduce lower frequencies more effectively. As discussed above, lower frequencies do not produce a lobing effect even though all the speakers of the device are reproducing the same low frequency content. By providing decorrelated high frequency portions to all of the speakers, a fuller sound may be produced by the device 900 for the high frequency portions of the audio program. The undesirable lobing effects between multiple speakers that are producing the high frequency portions of the audio program may be reduced or eliminated by decorrelating the high frequency portions before sending the signals to the speakers 102, 104, 106, 108.

Figure 10:
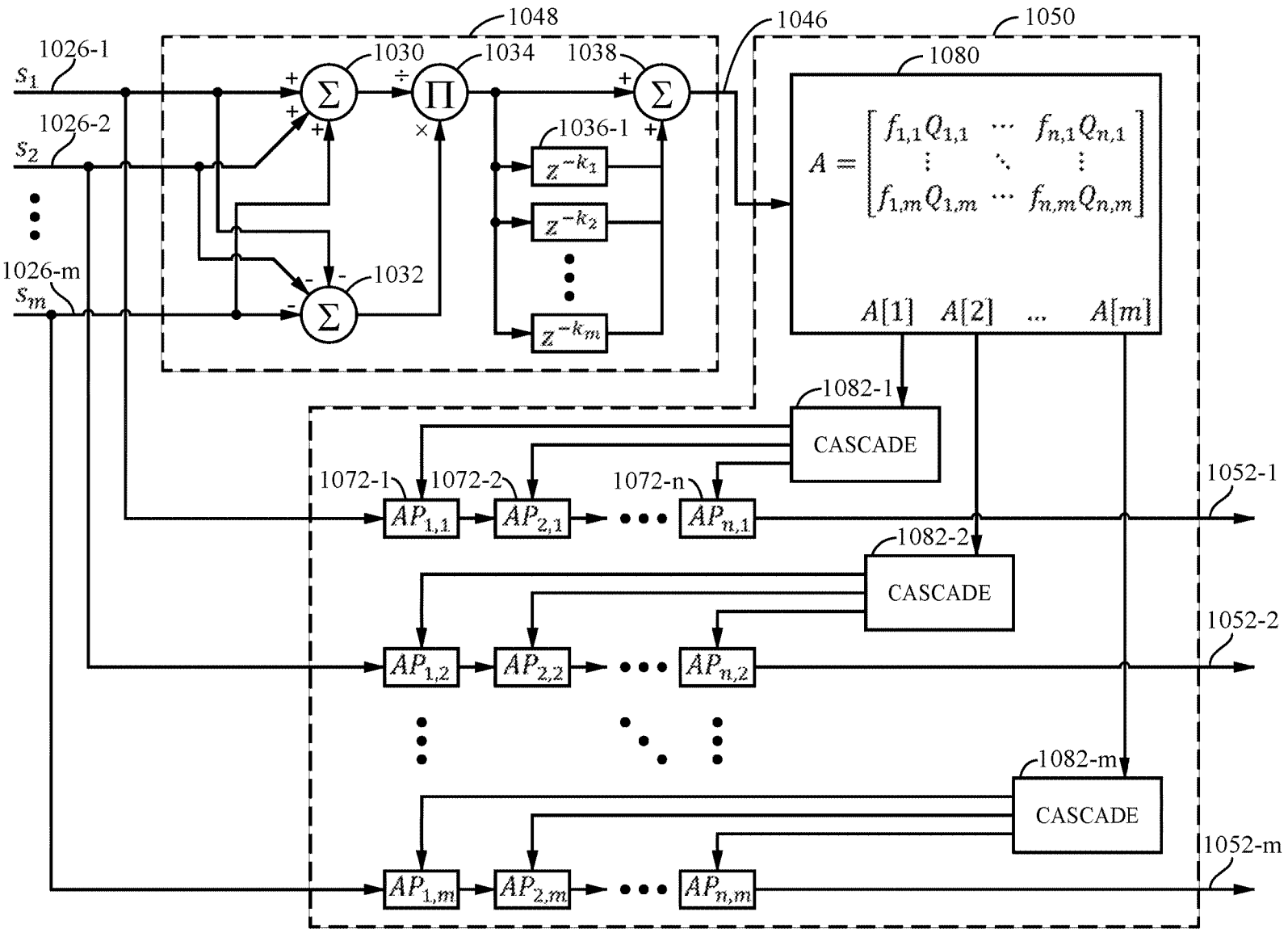
FIG. 10 is a block diagram of an exemplary generalized decorrelation metric generator and decorrelation engine

FIG. 10 is a block diagram of an exemplary generalized decorrelation metric generator 1048 and decorrelation engine 1050 that receives high frequency portions of m audio channels 1026-1, 1026-2, **1026-*m* and generates m decorrelated intermediate channel signals 1052-1, 1052-2, 1052-*m*. It will be appreciated that the decorrelation metric generator 1048 and decorrelation engine 1050 with m=2 could be incorporated into the device 900 shown in FIG. 9**.

The decorrelation engine 1050 may pass each high frequency portion of each audio channel 1026 through a chain of n all-pass filters 1072-1, 1072-2, **1072-*n* and to generate the decorrelated intermediate channel signal 1052**. An all-pass filter is a signal processing filter that passes all frequencies equally in gain, but changes the phase relationship among various frequencies by varying its phase shift as a function of frequency.

The all-pass filter is a linear, time-invariant, causal, digital filter with an equal number of inputs and outputs, whose transfer function in the Z-domain can be expressed as:

$$H(z) = \frac{B(z)}{A(z)} = \frac{B_1 + B_2 z^{-1} + \ldots + B_{n+1} z^{-n}}{A_1 + A_2 z^{-1} + \ldots + A_{n+1} z^{-n}}$$

The all-pass filters may be configured by optimizing the following parameters:

$f_{LP}$ cutoff frequency of low-pass filter
$n_{LP}$ order of low-pass filter
$f_{HP}$ cutoff frequency of high-pass filter
$n_{HP}$ order of high-pass filter
$N_{AP}$ general number of all-pass filters
AP $f_{start}$ general starting point in frequency spectrum of all-pass filters
AP $f_{stop}$ general stopping point in frequency spectrum of all-pass filters
AP $f_{n,m}$ frequency of all all-pass filters for n speakers and m audio channels
AP $Q_{n,m}$ quality factor (Q) of all all-pass filters The all-pass filter is calculated as:

$$\omega_0 = \frac{2\pi f_0}{f_s}$$

$$\text{alpha} = \frac{\sin(\omega_0)}{2Q}$$

where $f_0$ is the center frequency of the filter
Q is the quality factor (Q) of the filter
$f_s$ is the sampling frequency $$B_1 = 1 - \text{alpha}$$

$$B_2 = -2\cos(w_0)$$

$$B_3 = 1 + \text{alpha}$$

A is the inverse of B:

$$A_1 = B_3$$

$$A_2 = B_2$$

$$A_3 = B_1$$

A and B can be used to compute the transfer function for the all-pass filter.

The decorrelation engine 1050 may include a coefficient calculator 1080 to perform calculations of the coefficients for the all-pass filters. As suggested by the figure, the calculations may be performed using matrix mathematics. The coefficients for each of the n all-pass filters that process a single audio channel may be represented as a vector A[1] through A[m] for the m audio channels. Each all-pass filter in a channel chain may be configured with an element of the vector that is selected as distributed by a cascade circuit 1082-1, 1082-2, **1082-*m***.

It will be appreciated that when the number of speakers in the device is greater than the number of audio channels, it may be desirable to create decorrelated versions of some or all of the decorrelated intermediate channel signals so that aurally similar high frequency portions of the audio channel are reproduced by more than one speaker as discussed for the embodiment shown in FIG. 9.

The decorrelation engine 1050 may receive a channel decorrelation metric signal 1046 from the decorrelation metric generator 1048 that indicates the amount of decorrelation needed between the channels. The channel decorrelation metric signal 1046 may be used in the calculation of the coefficients for the all-pass filters.

The exemplary decorrelation metric generator 1048 shown in FIG. 10 forms a sum 1030 and a difference 1032 of all the high frequency portions of the audio channels 1026-1, 1026-2, **1026-*m*. The sum 1030 and a difference 1032 are then multiplied 1034. The product is sent in parallel to m delay lines 1036-1, 1036-2, 1036-*m*. The product and the m delayed products are summed 1038 to generate the channel decorrelation metric signal 1046**. In one embodiment, in-phase content in two channels produces a correlation coefficient of 1.0, whereas completely out-of-phase sine waves of the same frequency produce 0. Incoming decorrelated content such as uncorrelated noise will bounce around in time.

The channel decorrelation metric signal may be generated with other functions, such as the inverse autocorrelation function (IACF) equation:

$$IACF_t(\tau) = \frac{\left[\int_{t_1}^{t_2} p_L(t)p_R(t+\tau)dt\right]}{\left[\int_{t_1}^{t_2} p_L^2(t)dt\int_{t_1}^{t_2} p_R^2(t)dt\right]^{1/2}}$$

The channel decorrelation metric signal may be any metric that conveys how unique each channel's content is relative to every other channel's content at a given moment in time. For example, in the stereo case, the "stereo-ness" of the signal would be "not at all" for mono content and "very much" for completely unrelated content in each channel. The purpose of the channel decorrelation metric is to inform the decorrelation algorithm of the coefficient calculator 1080 how much decorrelation is required at a given time.

While certain exemplary embodiments have been described and shown in the accompanying drawings, it is to be understood that such embodiments are merely illustrative of and not restrictive on the broad invention, and that this invention is not limited to the specific constructions and arrangements shown and described, since various other modifications may occur to those of ordinary skill in the art. For example, while the embodiments have been described as applied to a tablet device, they may also be applied to other devices such as a cellular telephone or a computer monitor on a pivoting stand. As another example, the speaker components may each be comprised of several speaker driver elements such as a coaxial speaker driver or woofer/tweeter pair in close proximity. The description is thus to be regarded as illustrative instead of limiting.

What is claimed is:

1. A portable electronic device comprising:

a plurality of speakers on a left side and a right side of the portable electronic device, wherein at least two of the plurality of speakers are on the left side and at least two of the plurality of speakers are on the right side when the portable electronic device is in a first orientation and a second orientation, and wherein a distance between speakers on respective sides of the portable electronic device is different in the first orientation and the second orientation;

an audio source configured to provide a left audio signal and a right audio signal, wherein the audio signals have respective high frequency portions and low frequency portions;

an audio processor coupled to the audio source, the audio processor configured to attenuate the high frequency portions of the left audio signal and the right audio signal to produce a processed left audio signal and a processed right audio signal responsive to detecting a change in the distance between speakers on respective sides of the portable electronic device when the portable electronic device moves from the first orientation to the second orientation; and an audio router configured to direct the left audio signal having the high frequency portion of the left audio signal to only one of the speakers on the left side and the processed left audio signal having only the low frequency portion of the left audio signal to all of the speakers on the left side except for the only one speaker on the left side, and to direct the right audio signal having the high frequency portion of the right audio signal to only one of the speakers on the right side and the processed right audio signal having only the low frequency portion of the right audio signal to all of the speakers on the right side except for the only one speaker on the right side.

2. The portable electronic device of claim 1, wherein the speakers on the left side are a first pair of speakers when the portable electronic device is in the first orientation, and wherein the speakers on the left side are a second pair of speakers when the portable electronic device is in the second orientation.

3. The portable electronic device of claim 1 further comprising an orientation sensor configured to sense an orientation of the portable electronic device, and wherein the audio processor is configured to set a cutoff frequency for attenuating the high frequency portions based at least in part on the orientation.

4. The portable electronic device of claim 1, wherein the left audio signal is a left audio channel signal, and wherein the right audio signal is a right audio channel signal.

5. The portable electronic device of claim 4, wherein each speaker is located at a respective corner of the portable electronic device.

6. The portable electronic device of claim 5, wherein the at least two speakers on the left side is two speakers, and wherein the at least two speakers on the right side is two speakers.

7. The portable electronic device of claim 1, wherein the audio processor includes a low-pass filter to attenuate the high frequency portions.

8. An audio management system comprising:

an audio processor coupled to an audio source that provides an audio program having a first audio signal and a second audio signal, the audio processor configured to attenuate a high frequency portion of each of the first audio signal and the second audio signal responsive to detecting a change in a distance between speakers on respective sides of a portable electronic device when the portable electronic device moves from a first orientation to a second orientation to provide a processed first audio signal and a processed second audio signal; and an audio router configured to limit the high frequency portion of the first audio signal to a single speaker on a first side of the portable electronic device, to limit the high frequency portion of the second audio signal to a single speaker on a second side of the portable electronic device, to direct the processed first audio signal having only a low frequency portion of the first audio signal to all of a first plurality of speakers that are on the first side of the portable electronic device except for the single speaker on the first side of the portable electronic device, and to direct the processed second audio signal having only the low frequency portion of the second audio signal to all of a second plurality of speakers that are on the second side of the portable electronic device except for the single speaker on the second side of the portable electronic device.

9. The audio management system of claim 8, wherein the speakers on the first side are a first pair of speakers when the portable electronic device is in the first orientation, and wherein the speakers on the first side are a second pair of speakers when the portable electronic device is in the second orientation.

10. The audio management system of claim 8 further comprising an orientation sensor configured to sense an orientation of the portable electronic device, and wherein the audio processor is configured to set a cutoff frequency for attenuating the high frequency portions based at least in part on the orientation.

11. The audio management system of claim 8, wherein the first audio signal is a left audio channel signal, and wherein the second audio signal is a right audio channel signal.

12. The audio management system of claim 11, wherein the first plurality of speakers is two speakers, and wherein the second plurality of speakers is two speakers.

13. An electronic device comprising:

a display screen mounted in a housing having corners;

a plurality of speakers mounted at respective corners on a first side and a second side of the housing, wherein at least two of the plurality of speakers are on the first side and at least two of the plurality of speakers are on the second side when the electronic device is in a first orientation and a second orientation, and wherein a distance between speakers on respective sides of the electronic device is different in the first orientation and the second orientation;

an audio source configured to provide a first audio signal and a second audio signal, wherein the audio signals have respective high frequency portions and low frequency portions;

an audio processor coupled to the audio source, the audio processor configured to attenuate the high frequency portions of the first audio signal and the second audio signal to provide a processed first audio signal and a processed second audio signal responsive to detecting a change in a distance between speakers on respective sides of the electronic device when the electronic device moves from the first orientation to the second orientation; and an audio router configured to direct the first audio signal having the high frequency portion of the first audio signal to only one speaker on the first side and the processed first audio signal having only the low frequency portion of the first audio signal to all of the speakers on the first side except for the one speaker, and to direct the second audio signal having the high frequency portion of the second audio signal to only one speaker on the second side and the processed second audio signal having only the low frequency portion of the second audio signal to all of the speakers on the second side except for the one speaker.

14. The electronic device of claim 13, wherein the speakers on the first side are a first pair of speakers when the electronic device is in the first orientation, and wherein the speakers on the first side are a second pair of speakers when the electronic device is in the second orientation.

15. The electronic device of claim 13 further comprising an orientation sensor configured to sense an orientation of the electronic device, and wherein the audio processor is configured to set a cutoff frequency for attenuating the high frequency portions based at least in part on the orientation.

16. The electronic device of claim 13, wherein the first audio signal is a left audio channel signal, and wherein the second audio signal is a right audio channel signal.

17. The electronic device of claim 16, wherein the at least two speakers on the first side is two speakers, and wherein the at least two speakers on the second side is two speakers.

18. A portable electronic device comprising:

a first speaker, a second speaker, a third speaker, and a fourth speaker, wherein when the portable electronic device is in a first orientation the first speaker and the second speaker are on a left side of a vertical centerline of the portable electronic device and the third speaker and the fourth speaker are on a right side of the vertical centerline, wherein when the portable electronic device is in a second orientation the second speaker and the third speaker are on the left side and the first speaker and the fourth speaker are on the right side, wherein a distance between the first speaker and the second speaker is different than a distance between the second speaker and the third speaker, and wherein a distance between the third speaker and the fourth speaker is different than a distance between the first speaker and the fourth speaker;

an audio source configured to provide a left audio signal and a right audio signal, wherein the audio signals have respective high frequency portions and low frequency portions;

an audio processor coupled to the audio source, the audio processor configured to attenuate, responsive to detecting a change in the distance between speakers on respective sides of the vertical centerline when the portable electronic device moves from the first orientation to the second orientation, the high frequency portions of the left audio signal and the right audio signal to produce a low frequency left audio signal and a low frequency right audio signal; and an audio router configured to when the portable electronic device is in the first orientation, direct the left audio signal to only the first speaker, the low frequency left audio signal to only the second speaker, the low frequency right audio signal to only the third speaker, and the right audio signal to only the fourth speaker, and when the portable electronic device is in the second orientation, direct the left audio signal to only the second speaker, the low frequency left audio signal to only the third speaker, the low frequency right audio signal to only the fourth speaker, and the right audio signal to only the first speaker.

19. The portable electronic device of claim 18 further comprising a display screen, wherein the vertical centerline is a vertical centerline of the display screen in the first orientation and the second orientation.

20. The portable electronic device of claim 18 further comprising an orientation sensor configured to sense an orientation of the portable electronic device, wherein the audio processor is configured to set a cutoff frequency for attenuating the high frequency portions based at least in part on the orientation.

21. The portable electronic device of claim 18, wherein the left audio signal is a left audio channel signal, and wherein the right audio signal is a right audio channel signal.

22. The portable electronic device of claim 18, wherein each speaker is located at a respective corner of the portable electronic device.

* * * * *